US011898313B2

(12) United States Patent
Bowyer et al.

(10) Patent No.: US 11,898,313 B2
(45) Date of Patent: Feb. 13, 2024

(54) BARRIER SYSTEM

(71) Applicant: HILL & SMITH LIMITED, Wolverhampton (GB)

(72) Inventors: Steven Bowyer, Wolverhampton (GB); Andrew Pardoe, Brierly Hill (GB); Matthew Harriman, Swadlincote (GB)

(73) Assignee: HILL & SMITH LIMITED

( * ) Notice: Subject to any disclaimer, the term of this patent is extended or adjusted under 35 U.S.C. 154(b) by 738 days.

(21) Appl. No.: 15/773,595

(22) PCT Filed: Nov. 3, 2016

(86) PCT No.: PCT/GB2016/053404
§ 371 (c)(1),
(2) Date: May 4, 2018

(87) PCT Pub. No.: WO2017/077298
PCT Pub. Date: May 11, 2017

(65) Prior Publication Data

US 2018/0320328 A1 Nov. 8, 2018

(30) Foreign Application Priority Data

Nov. 6, 2015 (GB) ..... 1519614

(51) Int. Cl.
*E01F 15/06* (2006.01)
*E01F 13/12* (2006.01)
*E01F 15/14* (2006.01)

(52) U.S. Cl.
CPC ..... *E01F 15/06* (2013.01); *E01F 13/12* (2013.01); *E01F 15/146* (2013.01)

(58) Field of Classification Search
CPC ..... E01F 15/06; E01F 15/146; E01F 15/02; E01F 15/065; E04H 17/06; E04H 17/10;
(Continued)

(56) References Cited

U.S. PATENT DOCUMENTS 735,263 A * 8/1903 Huxley ..... E04H 17/06 256/51
768,231 A * 8/1904 Kypke ..... E04H 17/10 256/49
(Continued)

FOREIGN PATENT DOCUMENTS

CN 201162189 12/2008
DE 1296152 B * 5/1969 ..... E01F 15/06
(Continued)

OTHER PUBLICATIONS

Translation of KR 20100043406 A. Lee. A separatable guardrail. Apr. 29, 2010. (Year: 2010).*
(Continued)

*Primary Examiner* — Amber R Anderson
*Assistant Examiner* — Zachary A Hall
(74) *Attorney, Agent, or Firm* — McDonald Hopkins LLC

(57) ABSTRACT

A security barrier system (1) and a bracket (2*a*, 2*b*) therefor are disclosed. The bracket comprises at least one each of a first type and a second type of mutually spaced fence member receiving channels (8*a*,8*b*,10*a*-10*f*), the or each channel of the second type (8*a*, 8*b*) having a greater width than the or each channel of the first type (10*a*-10*f*), as measured along a length of the bracket. The security barrier system comprises a plurality of support posts (4), attached to each support post is at least one bracket, the length of the bracket orientated vertically, and a plurality of fence members (12*a*-12*h*) orientated horizontally, each member passing through a corresponding one of the fence member receiving channels of each bracket.

14 Claims, 2 Drawing Sheets

Figure 1:
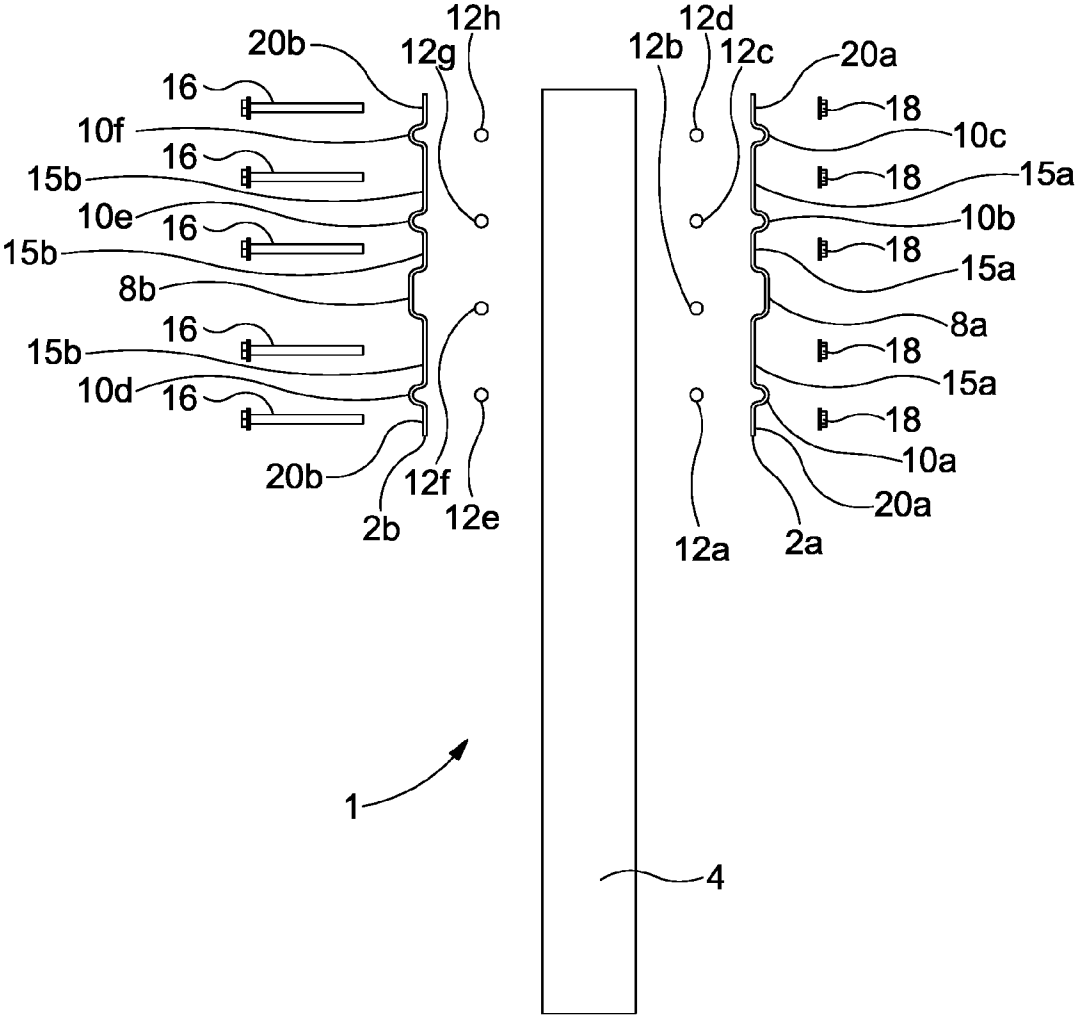

(58) Field of Classification Search
CPC ..... E04H 17/12; E04H 17/02; E04H 17/04; E04H 17/124
USPC ..... 256/13.1, 32, 49, 52, 54, 55, 47, 48
See application file for complete search history.

(56) References Cited

U.S. PATENT DOCUMENTS 805,201 A * 11/1905 Harris ..... E04H 12/20 256/52
829,150 A * 8/1906 Haffey ..... E04H 17/003 256/55
1,106,691 A * 8/1914 Willis ..... E04H 17/10 256/52
1,207,021 A * 12/1916 Gossett ..... E04H 17/124 256/57
1,249,186 A * 12/1917 Perry ..... E04H 17/12 256/52
2,005,418 A 6/1935 Gleason et al.
2,201,313 A 5/1940 Hayden et al.
2,204,559 A * 6/1940 Ahles ..... E01F 15/06 256/13.1
2,303,252 A * 11/1942 Blessing ..... E01F 15/06 256/13.1
2,317,249 A * 4/1943 Brickman ..... E01F 15/06 248/66
2,321,988 A * 6/1943 Brickman ..... E01F 15/06 256/13.1
2,349,648 A * 5/1944 Brickman ..... E01F 15/06 256/13.1
4,465,263 A 8/1984 Robbins
4,709,887 A * 12/1987 Bongiovanni ..... F16L 3/2235 248/66
4,973,029 A 11/1990 Robbins
6,039,150 A * 3/2000 Palmer ..... E04G 3/26 182/113
6,190,085 B1 * 2/2001 Johansson ..... E01F 15/025 404/6
6,517,280 B2 * 2/2003 Carter ..... E01F 13/02 256/13.1
6,609,343 B1 * 8/2003 Litten ..... A63B 71/023 248/228.5
6,857,621 B1 * 2/2005 Kamarad ..... E04H 17/124 256/48
7,188,809 B1 * 3/2007 Roth ..... F16B 7/0433 248/58
7,249,908 B2 * 7/2007 Bergendahl ..... E01F 15/025 256/13.1
8,424,852 B2 * 4/2013 Anson ..... E04G 21/3219 256/68
8,992,116 B2 * 3/2015 Sloan ..... E04H 17/04 404/6
2002/0053664 A1 * 5/2002 Moore ..... E01F 15/0438 256/13.1
2003/0215305 A1 * 11/2003 Alberson ..... F16B 2/065 411/400
2006/0145131 A1 * 7/2006 Purvis ..... E04G 21/3223 256/13.1
2009/0321699 A1 12/2009 Payne
2010/0090185 A1 * 4/2010 Mauer ..... E01F 15/06 256/13.1
2011/0253961 A1 * 10/2011 Gripne ..... E01F 15/025 256/13.1

FOREIGN PATENT DOCUMENTS

FR 374984 A * 6/1907 ..... E04H 17/10
GB 2544094 A * 5/2017 ..... E01F 15/06
JP 61076817 9/1984
JP 06057919 8/1992
JP 06193023 A * 7/1994
KR 200177194 Y1 4/2000
KR 20010038608 5/2001
KR 20100043406 A 4/2010
KR 20100086543 A * 8/2010
KR 101049437 7/2011
KR 101056065 B1 * 8/2011 ..... E01F 15/06
WO WO-2010143826 A2 * 12/2010 ..... E01F 15/146
WO 2015033100 A1 3/2015

OTHER PUBLICATIONS

Intellectual Property Office, Search Report for Patent Application No. GB1519614.0, drafted Apr. 20, 2016, dated Apr. 21, 2016.
International Search Report and Written Opinion dated Jan. 20, 2017; in International Patent Application No. PCT/GB2016/053404 filed on Nov. 3, 2016; ISA/EP.
New Zealand Office Action dated Aug. 20, 2020; New Zealand Application No. 742096.
Japanese Office Action dated Nov. 10, 2020; Japanese Patent Application No. 2018-543459.

* cited by examiner

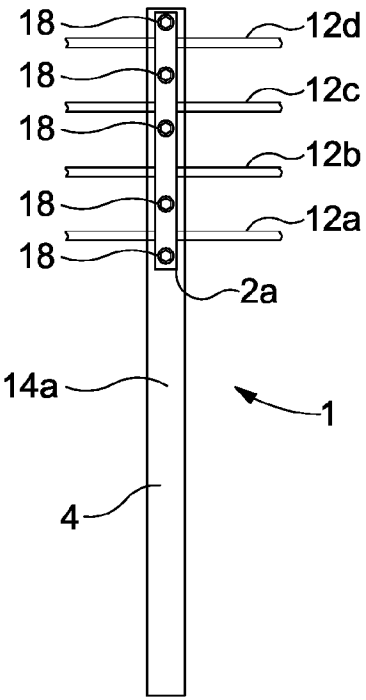
Figure 2c
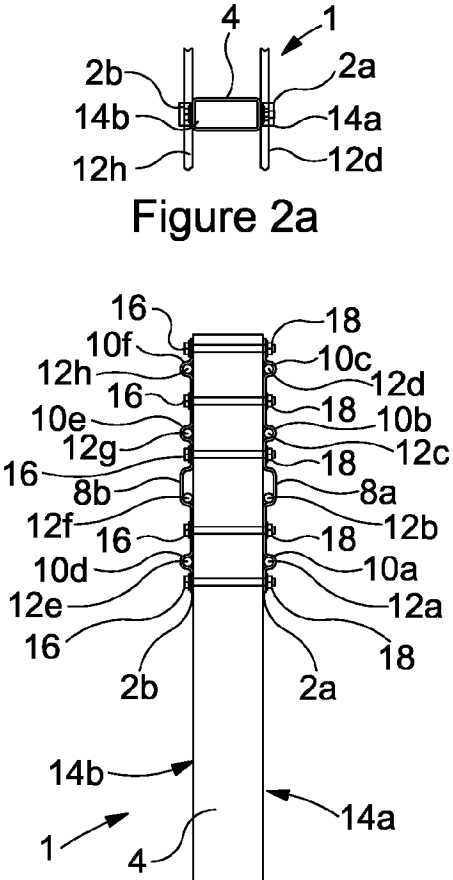
Figure 2a
Figure 2b

BARRIER SYSTEM

CROSS-REFERENCE TO RELATED APPLICATION

This application is a 35 U.S.C. § 371 national stage filing of PCT Application No. PCT/GB2016/053404 filed on Nov. 3, 2016, entitled "BARRIER SYSTEMS," which claims priority to Great Britain Patent Application No. 1519614.0, filed on Nov. 6, 2015, each of which are incorporated herein in their entirety by reference.

This invention relates to barrier systems, and in particular but not exclusively, to security barriers that provide a perimeter protection against vehicular intrusion around airports and the like.

Security barriers are designed to resist vehicle impacts in a direction substantially perpendicular to the security barrier. In contrast, conventional road crash barriers are designed to deflect vehicles impacting the fence an angle of 15 to 25 degrees relative to the fence (i.e. small angles) at speeds up to 110 km/h (68 mph). Security barriers may be used as anti-terrorist fences or perimeter security barriers for restraining heavy vehicles.

According to a first aspect of the present invention, there is provided an elongate bracket comprising at least one each of a first type and a second type of mutually spaced fence member receiving channels, the or each channel of the second type having a greater width than the or each channel of the first type, as measured along a length of the bracket.

It will be understood that, when a bracket of the present invention is used to attach (horizontal) fence members to a (vertical) support post in a security barrier system, the or each channel of the second type allows its respective fence member to slide upwardly along the support post and within the channel during an impact of a vehicle with the security barrier system. This has the advantage that the energy from the impact can be absorbed in a controlled and load shedding manner.

In an embodiment, the bracket further comprises a plurality of non-channel regions. The non-channel regions may comprise an interconnecting region between each pair of adjacent channels. The non-channel regions may comprise a pair of end regions at the ends of the bracket.

In an embodiment, one or more of the non-channel regions comprises an aperture. The aperture provides a means by which the bracket may be attached to a support post.

In an embodiment, the non-channel regions lie in a common plane, with the channels extending out of the common plane. The non-channel regions may be planar.

In an embodiment, each of the first type of channels has a substantially semi-circular cross-section. In use, a cross-section of this shape allows the fence member to be better held against the support post, and helps to hold the fence member in place during the impact of the vehicle. Additionally, a bracket with a channel of this shape is easy to manufacture.

In an embodiment, each of the second type of channels has a linear central region between arcuate end regions. The linear region extends in a direction parallel to the length of the bracket. In use, a cross-section of this shape helps to hold the fence member against the support post but to slide along the support post during the impact of the vehicle. Additionally, a bracket with a channel of this shape is easy to manufacture.

In an embodiment, the bracket comprises one channel of the second type. In an embodiment, the bracket comprises at least two channels of the first type. In an embodiment, the bracket comprises three channels of the first type.

In an embodiment where more than one channel of either type is provided, the channels can be arranged in any order along the length of the bracket.

In an embodiment, a channel nearest to a first end of the bracket is a channel of the first type, and a channel second nearest to the first end of the bracket is a channel of the second type.

According to a second aspect of the present invention, there is provided a security barrier system comprising a plurality of support posts, attached to each support post at least one bracket in accordance with the first aspect, the length of the bracket orientated vertically, and a plurality of fence members orientated horizontally, each member passing through a corresponding one of the fence member receiving channels of each bracket.

In an embodiment, each support post has attached thereto two brackets in accordance with the first aspect. In an embodiment, the two brackets attached to the support post are substantially identical to each other.

In an embodiment, the two brackets are attached to each support post at the same position along a length of the support post.

In an embodiment, at least one bolt attaches the two brackets to each support post, each bolt extending through the aperture of a non-channel region of a first of the two brackets, an aperture of the support post, and an aperture of a non-channel region of a second of the two brackets. Using bolts to attach the support posts in this manner simplifies assembly of the security barrier system. The security barrier system may be assembled in situ more easily.

In an embodiment, the support post has a substantially rectangular cross section. A support post with this cross section is easy to manufacture. In an embodiment, the non-channel regions of the brackets are flush with the support post, and are therefore planar. An advantage of this feature is that the security barrier system is more compact. The support post may be of circular cross section, in which case the non-channel regions of the brackets may be correspondingly curved.

In an embodiment, the horizontal fence members have a circular cross-section defining a fence member diameter. In an embodiment, each channel of the first type has a width substantially equal to the fence member diameter. In an embodiment, each channel of the first type has a depth substantially equal to the fence member diameter. This helps to hold the fence member in place during the impact of the vehicle.

In an embodiment, each channel of the second type has a depth substantially equal to the fence member diameter and a width greater than the fence member diameter. This helps to hold the fence member against the support post but to slide along the support post during the impact of the vehicle The fence members may be cables or bars.

Embodiments of the present invention will now be described with reference to the accompanying figures, in which:

FIG. 1 is an exploded side view of a security barrier system, according to an embodiment of the present invention;

FIG. 2*a* is a plan view of a security barrier system, according to an embodiment of the present invention;

FIG. 2*b* is a side view of a security barrier system, according to an embodiment of the present invention; and FIG. 2*c* is a front view of a security barrier system, according to an embodiment of the present invention.

FIG. 1 shows an exploded side view of a security barrier system 1, which includes a pair of brackets 2*a*, 2*b* according to an embodiment of the first aspect of the present invention. Each bracket 2*a*, 2*b* is elongate, and each includes three fence member receiving channels of a first type 10*a*-10*f* and one fence member receiving channel of a second type 8*a*, 8*b*. The fence member receiving channels are mutually spaced along the bracket. The channel of the second type 8*a*, 8*b* has a greater width than the channels of the first type 10*a*-10*f*, as measured along the length of the bracket (which is shown vertically).

Each bracket 2*a*, 2*b* comprises a plurality of non-channel regions 15*a*, 15*b*, 20*a*, 20*b*. The non-channel regions comprise interconnecting regions 15*a*, 15*b* between each pair of adjacent channels 8*a*, 8*b*, 10*a*-10*f*, and a pair of end regions 20*a*, 20*b*, at respective opposite ends of the bracket 2*a*, 2*b*.

Each non-channel region 15*a*, 15*b*, 20*a*, 20*b* comprises an aperture, which provides a means by which the brackets 2*a*, 2*b* are fixed to a support post 4. This is described in more detail below. It will be appreciated that in other embodiments (not shown), only some (one or more) of the non-channel regions 15*a*, 15*b*, 20*a*, 20*b* comprise an aperture.

The non-channel regions 15*a*, 15*b*, 20*a*, 20*b* lie in a common plane, while the channels 8*a*, 8*b*, 10*a*-10*f* extend out of the common plane. The non-channel regions 15*a*, 15*b*, 20*a*, 20*b* are planar.

The channel 10*a*, 10*d* nearest to a first (lower) end of each bracket 2*a*, 2*b* is a channel of the first type, while the channel 8*a*, 8*b*, second nearest to the first end of each bracket 2*a*, 2*b* is a channel of the second type.

The bracket may be constructed from any suitable material. In the present embodiment, the bracket is constructed from steel.

In use, the brackets 2*a*, 2*b* are fixed to a support post 4, in a manner described in more detail below, to form the security barrier system 1. Each of the channels 8*a*, 8*b*, 10*a*-10*f* supports one of a series of horizontal fence members 12*a*-12*h*, and each of the channels of the second type 8*a*, 8*b* allows its respective fence member 12*b*, 12*f* to slide upwardly along the support post 4 during an impact of a vehicle with the security barrier system 1.

Referring to FIGS. 2*a* to 2*c*, there are shown three views of an assembled security barrier system 1, according to an embodiment of the second aspect of the present invention. FIG. 2*a* shows a plan view of the security barrier system, FIG. 2*b* shows a side view and FIG. 2*c* shows a front view.

The security barrier system 1 comprises a plurality of support posts 4 (only one is shown in FIGS. 2*a* to 2*c*). Attached to each support post is a pair of brackets 2*a*, 2*b*, as described above with reference to FIG. 1. The support posts 4 and the lengths of the brackets 2*a*, 2*b* are orientated vertically. The security barrier system 1 comprises a plurality of steel cables which serve as horizontal fence members 12*a*-12*h*, with each cable passing through a corresponding one of the fence member receiving channels 8*a*, 8*b*, 10*a*-10*f* of each bracket 2*a*, 2*b*.

The non-channel regions 15*a*, 15*b*, 20*a*, 20*b* are flush with the support post 4. The support post 4 has an approximately rectangular cross section. In other embodiments (not shown), the support post has an approximately square cross-section.

One of the brackets 2*a* is attached to a front face 14*a* of the support post 4, and the other bracket 2*b* is attached to a rear face 14*b* of the support post 4. The first and second brackets 2*a*, 2*b* are attached to the support post 4 at the same position along a length of the support post 4.

In other embodiments (not shown), the fence members 12*a*-12*h* are bars.

The channels of the first type 10*a*-10*f* have a width (in a direction parallel to a longitudinal axis of the support post 4) and depth (in a direction perpendicular to the longitudinal axes of the support post 4 and the fence members 12*a*-12*h*), both approximately equal to the diameter of the cables. In this case, this is achieved by the channels of the first type 10*a*-10*f* having a semi-circular cross-section.

The channels of the second type 8*a*, 8*b* have a depth approximately equal to the cable diameter, but have a width greater than the cable diameter. This is achieved by the channels of the second type 8*a*, 8*b* having a linear central region between arcuate end regions, with the linear portion extending in a direction parallel to the length of the bracket. In the present embodiment, the arcuate end regions are quarter circles.

The brackets 2*a*, 2*b* are fixed to the support post 4 by a series of bolts 16. Each bolt 16 extends through the aperture of a non-channel region 15*b*, 20*b* of the second bracket 2*b*, an aperture of the support post 4, and the corresponding aperture of a non-channel region 15*a*, 20*a* of the first bracket 2*a*. The bolts 16 are held in place by a series of nuts 18. It will be appreciated that in some embodiments, bolts 16 will only extend through only some (one or more) of the non-channel regions 15*a*, 15*b*, 20*a*, 20*b*.

The support post may be constructed from any suitable material. In the present embodiment, the support post is constructed from steel.

As described above, for each bracket 2*a*, 2*b*, the lowest of the channels (at the lowest height on the support post 4) is a channel of the first type 10*a*, 10*e*, while a second lowest is a channel of the second type 8*a*, 8*b*. The channels of the second type 8*a*, 8*b* are located at a critical loading point, determined based on the type of vehicle which is expected to impact the barrier. Positioning the channels of the second type 8*a*, 8*b* at a critical loading point means that they are located at the height of the stiffest area of the vehicle which is expected to impact the barrier (i.e. at the height of the vehicle's bumper). The effect of positioning the channels of the second type 8*a*, 8*b* at a critical loading point is described below.

On impact of a vehicle with the security barrier system 1, the channels of the second type 8*a*, 8*b* allow their respective cables 12*b*, 12*f* to slide upwardly along the support post 4. This allows the energy from the vehicle impact to be absorbed and shed, the energy transferring along the cables to posts adjacent to the impact zone.

In some cases, when the channels of the second type 8*a*, 8*b* are located at the critical loading point, on vehicle impact, the upward sliding of the cables 12*b*, 12*f* shifts them away from the stiffest areas of the vehicle.

In other cases, when the channels of the second type 8*a*, 8*b* are located at the critical loading point, on vehicle impact, the cables 12*b*, 12*f* slide upwardly, keeping their position on the vehicle, with the vehicle moving upwardly with the cables 12*b*, 12*f*.

In either of the cases described above, positioning the channels of the second type 8*a*, 8*b* at the critical loading point further improves the dissipation of energy, as this helps to spread the load from the vehicle into all of the fence members 12*a*-12*f* as evenly as possible.

List of Reference Numerals

| | |
|---|---|
| 1 | Security barrier system |
| 2a, 2b | Bracket |
| 4 | Support post |

-continued

| List of Reference Numerals | |
|---|---|
| 8a, 8b | Extended slot |
| 10a, 10b, 10c, 10d, 10e, 10f | Unextended slot |
| 12a, 12b, 12c, 12d, 12e, 12f, 12g, 12h | Fence member |
| 14a | Front face |
| 14b | Rear face |
| 15a, 15b | Interconnecting region |
| 16 | Bolt |
| 18 | Nut |
| 20a, 20b | End region |

The invention claimed is:

1. A security barrier comprising:

a plurality of support posts, and attached to a single face of each support post at least one elongated bracket comprising:

mutually spaced fence member receiving channels comprising one channel of a second type and at least one channel of a first type aligned on each side of the one channel of the second type, the channel of the second type having a greater width than each channel of the first type, as measured along a length of the bracket, wherein each of the channels of the first type has a substantially semi-circular cross-section and wherein the channel of the second type has a linear central region between arcuate end regions; and a plurality of non-channel regions, the non-channel regions comprising an interconnecting region between each pair of adjacent channels, wherein the plurality of interconnecting regions lie in a common plane, the channels of the first and second types extending out of the common plane and parallel to the common plane, and wherein at least one of the interconnecting regions comprises an aperture, the aperture extending through the common plane and being configured to receive a fastener in a plane perpendicular to the common plane and a plane of the channels for securing the elongated bracket to the single face of the support post;

a plurality of fence members orientated horizontally, each member of the plurality of fence members passing through a corresponding one of the fence member receiving channels of the at least one elongated bracket attached to each support post, wherein each fence member receiving channel of the first type has a width and depth approximately equal to a diameter of a corresponding fence member, and wherein the fence member receiving channel of the second type allows its respective fence member to slide upwardly along the support post and within the channel during an impact of a vehicle with the security barrier system.

2. The security barrier as claimed in claim 1, wherein the non-channel regions comprise a pair of end regions at ends of the bracket.

3. The security barrier as claimed in claim 1, wherein each of the interconnecting regions comprises an aperture.

4. The security barrier of claim 1, comprising three channels of the first type.

5. The security barrier as claimed in claim 1, wherein a channel nearest to a first end of the bracket is of the first type, and a channel second nearest to the first end of the bracket is of the second type.

6. The security barrier as claimed in claim 1, wherein each support post of the plurality of support posts has attached thereto two elongated brackets, the lengths of the elongated brackets orientated vertically.

7. The security barrier as claimed in claim 6, wherein the two elongated brackets attached to each support post of the plurality of support posts are identical to each other and attached to each support post of the plurality of support posts at a same position along a length of the support post.

8. The security barrier as claimed in claim 7, wherein at least one bolt attaches the two elongated brackets to each support post of the plurality of support posts, the at least one bolt extending through:

an aperture of a non-channel region of a first of the two elongated brackets;

an aperture of the support post; and an aperture of a non-channel region of a second of the two elongated brackets.

9. The security barrier as claimed in claim 1, wherein the support posts have substantially rectangular cross sections.

10. The security barrier as claimed in claim 1, wherein the non-channel regions of the elongated brackets are flush with the support posts.

11. The security barrier as claimed in claim 1, wherein each fence member of the plurality of fence members has a circular cross-section, the circular cross-section having a fence member diameter.

12. The security barrier of claim 1, wherein each channel of the fence member receiving channels of the second type has a depth substantially equal to the fence member diameter and a width greater than the fence member diameter.

13. The security barrier as claimed in claim 1 further comprising a single sheet of material bent to form the first type and second type of mutually spaced fence member receiving channels.

14. The security barrier as claimed in claim 1, wherein the aperture is located between a pair of adjacent channels.

* * * * *